United States Patent [19]

Christini

[11] 4,286,946

[45] Sep. 1, 1981

[54] CALCINER REVERSE FEED DISCHARGE SPIRAL

[75] Inventor: James N. Christini, Towanda, Pa.

[73] Assignee: GTE Products Corporation, Stamford, Conn.

[21] Appl. No.: 143,234

[22] Filed: Apr. 24, 1980

[51] Int. Cl.[3] ..... F27B 6/08; F27D 3/00

[52] U.S. Cl. ..... 432/112; 34/135; 414/149; 414/197; 432/117; 432/118; 432/239

[58] Field of Search ..... 432/112, 117, 118, 239; 414/149, 197; 34/135, 136, 137

[56] References Cited

U.S. PATENT DOCUMENTS

| | | | |
|---|---|---|---|
| 1,656,924 | 1/1928 | Smith | 432/112 |
| 2,522,025 | 9/1950 | Erisman | 34/135 |
| 3,272,489 | 9/1966 | Heyer et al. | 432/117 |
| 3,441,259 | 4/1969 | Heyer et al. | 432/117 |

FOREIGN PATENT DOCUMENTS

| | | | |
|---|---|---|---|
| 5997 | of 1906 | United Kingdom | 432/118 |

*Primary Examiner*—John J. Camby

*Attorney, Agent, or Firm*—Thomas H. Buffton

[57] ABSTRACT

A calciner has a rotatable indirectly-heated cylindrical retort with a material receiving end and a material discharge end and a reverse pitch spiral is affixed internal of the cylindrical retort at the material discharge end.

11 Claims, 3 Drawing Figures

CALCINER REVERSE FEED DISCHARGE SPIRAL

TECHNICAL FIELD

This invention relates to calciners and more particularly to an improved calciner cylindrical retort for increasing material retention time of a calciner.

CROSS REFERENCE TO OTHER APPLICATIONS

A concurrently filed application, filed in the names of James Nicholas Christini, Tai Kyung Kim, and Robert Paul McClintic, Ser. No. 143,236 filed Apr. 24, 1980 and assigned to the Assignee of the present application includes materials related to the present application.

BACKGROUND ART

Calciners and particularly indirectly-heated calciners are utilized for heat-treating and drying of materials at temperatures higher than those normally employed in steam-heating apparatus. For example, indirectly-heated calciners having a rotating cylindrical retort are frequently employed to reduce mineral oxides to low oxides, dry and remove sulfur from cobalt, copper and nickel powders, reduce metal oxides, and numerous other similar applications wherein relatively high temperatures are desirable.

In the known types of calciners employing a rotating cylindrical retort, it is a common practice to feed the material for processing into one end of the retort and collect the processed material from an opposite discharge end. Also, a series of flights attached to the inner surface of the rotatable retort or a scraper "chain" may be utilized to control the progress of the material as it is processed through the rotating cylindrical retort.

Although the above-mentioned flights and scraper "chains" are necessary to insure continued progress of the materials through the cylindrical retort, a problem exists in that it would be highly desirable to increase the retention time or the time during which the material being processed remains in the cylindrical retort. Such an increase in retention time obviously leads to a highly desirable increase in loading capacity and enhanced utilization of the apparatus.

One known technique for achieving the abovementioned increase in material retention time is to introduce a dam or screen into the discharge end of the cylindrical retort. Thus, the contained materials must either reach a height sufficient to spill over the dam or be of a size small enough to pass through the screen. Unfortunately, it has been found that both dams and screens are undesirably accompanied by pluggage of the retort. Moreover, attempts to clear the undesired pluggage result in undesired and expensive shutdown time or, in the case of screens, replacement thereof due to perforations encountered in attempts to unplug the screen. In both cases efficiency and costs suffer.

DISCLOSURE OF THE INVENTION

In one aspect of the invention, a calciner is provided having a rotatable cylindrical retort with a material receiving end and a material discharge end and a reverse pitch spiral is positioned internal of the material discharge end of the cylindrical retort.

BEST MODE FOR CARRYING OUT THE INVENTION

Figure 1:
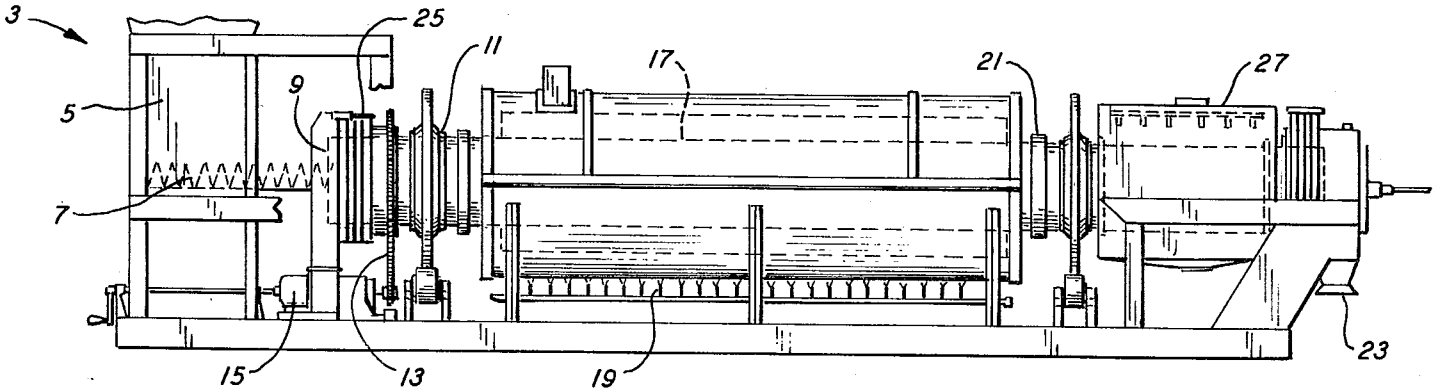
FIG. 1 is a diagrammatic illustration of a calciner having an indirectly-heated rotatable cylindrical retort.

For a better understanding of the present invention, together with other and further objects, advantages and capabilities of the invention, reference is made to the following disclosure and appended claims in conjunction with the accompanying drawings.

Referring to the drawings, a calciner 3 includes a material receiving bin 5 with a screw feed 7 connecting the receiving bin 5 to a material receiving end 9 of a cylindrical retort 11. A chain drive 13 is coupled to the cylindrical retort 11 and to a motor drive 15 which provides energy for rotating the cylindrical retort 11.

The cylindrical retort 11 has a "hot zone" 17 which, in this instance, is indirectly-heated by a plurality of burners 19. This "hot zone" 17 extends to a material discharge end 21 wherefrom the processed materials are exited through a discharge chute 23. Moreover, a first and second bellows arrangement 25 and 27 is provided at the material receiving and material discharge ends, 9 and 21 respectively, whereby atmospheric control internal of the cylindrical retort 11 is maintained.

Figure 3:
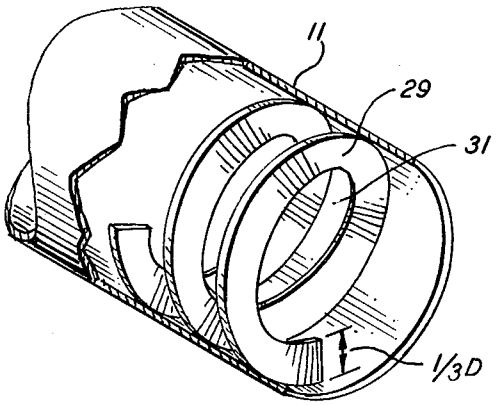
FIG. 3 is a perspective view of the embodiment of FIG. 2.
Figure 2:
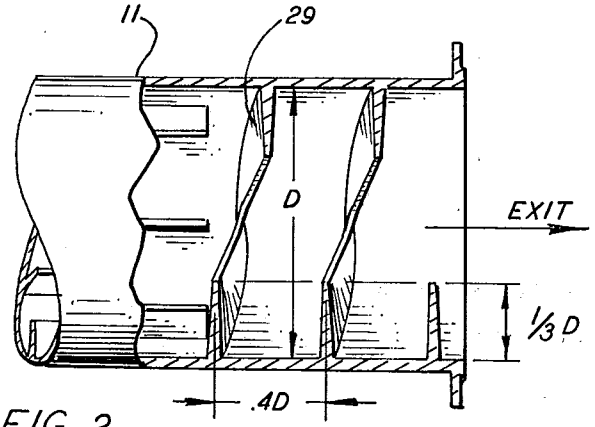
FIG. 2 is a sectional view of the retort of FIG. 1 including a preferred form of reverse pitch spiral.

Referring to FIGS. 2 and 3, the cylindrical retort 11 has an internal diameter "X" and a material discharge end 21 wherein is affixed, by welding or casting for example, a two-turn reverse pitch spiral 29. The reverse pitch spiral 29 preferably has a height of about one-third ($\frac{1}{3}$ X) the internal diameter (X) of the cylindrical retort 11. Also, the two-turn reverse pitch spiral 29 has a pitch of about forty percent (40%) of the internal diameter (X) of the cylindrical retort 11. Thus, the reverse pitch spiral 29 provides a central open circular area 31 of a diameter approximately equal to one-third the internal diameter ($\frac{1}{3}$ X) of the cylindrical retort 11.

As a specific illustration which is in no way to be construed as limiting the invention, a calciner having a cylindrical retort measuring about eighteen (18.0) feet had an inner diameter of about thirty (30) inches. A two-turn reverse pitch spiral had a height of about 10 inches and a pitch of about 40% or about 12 inches.

As to operation, the calciner is continuously loaded with material to be processed and the cylindrical retort 11 is rotated, counter-clockwise in FIG. 2, while being heated from an external source. As the material reaches the reverse pitch spiral at the discharge end, the material is continually fed back into the "hot zone" of the cylindrical retort by the action of the reverse pitch spiral. When the processed material exceeds the height of the spiral the processed material is discharged into the processed material container.

Tests conducted on a calciner similar to the above-described specific configuration provided an increase in material retention time in the range of about 24 to 48 times that of a normal cylindrical retort without a reverse pitch spiral. Moreover, this increased retention time is readily translated into an increased production rate and an increased loading capacity in the range of about 10 to 20 times that of a cylindrical retort not having a reverse pitch spiral.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

The above-described calciner is preferably in the form of an indirectly-heated rotary cylindrical retort having a reverse pitch spiral affixed internal to the material discharge end of the retort. The calciner is especially suitable to processing materials which require relatively high temperatures and extended processing times.

I claim:

1. A reverse feed spiral for a refractory metal reclaiming calciner having a cylindrical rotatable retort of a given inner diameter with a material-receiving end and a material discharging end separated by a hot zone and coupled to a motor drive source for effecting rotation of said rotatable retort in a given direction to provide material flow in a given direction, said reverse feed spiral characterized by the improvement wherein a spiral having a reverse pitch with respect to said given direction of rotation and of material flow within said rotatable retort is positionally located within said material-discharging end of said rotatable retort whereby the direction of material flow within said material-discharge end of said rotatable retort is reversed by said reverse feed spiral and retention time of said material within said rotatable retort is increased.

2. The calciner of claim 1 wherein said reverse pitch spiral is in the form of a two-turn reverse pitch spiral.

3. The calciner of claim 1 wherein said reverse pitch spiral has a height substantially equal to about one-third the inside diameter of said cylindrical retort.

4. The calciner of claim 1 wherein said reverse pitch spiral has a pitch of about 40% of the inside diameter of said cylindrical retort.

5. The calciner of claim 1 wherein said reverse pitch spiral has an open air flow area substantially equal to a circle having a diameter of about one-third the inside diameter of said cylindrical retort.

6. The calciner of claim 1 wherein said reverse pitch spiral is cast internal of said material discharge end of said cylindrical retort.

7. The calciner of claim 1 wherein said reverse pitch spiral is affixed by welding internal of the material discharge end of said cylindrical retort.

8. In a refractory metal reclaiming calciner having a cylindrical rotatable retort with a given inner diameter, a material-receiving end, a material discharging end and a hot zone between said material receiving and discharging ends with said rotatable retort coupled to a motor drive effecting rotation thereof and material flow therein in a given direction, a reverse feed spiral positionally located within said material discharging end of said rotatable retort and characterized by the improvement wherein said feed spiral has a reverse pitch with respect to said given direction of material flow whereby the direction of material flow within said material-discharging end is reversed with respect to said material flow in said retort by said reverse feed spiral to effect increased retention time of said material within said rotatable retort.

9. The cylindrical retort of claim 8 wherein said reverse pitch spiral is a two-turn reverse pitch spiral.

10. The cylindrical retort of claim 9 wherein said two-turn reverse pitch spiral has a uniform height of about one-third the internal diameter of said cylindrical retort.

11. The cylindrical retort of claim 9 wherein said two-turn reverse pitch spiral has a pitch substantially equal to about 40% of the inside diameter of said cylindrical retort.

* * * * *